US012747531B2

(12) United States Patent
Zhao et al.

(10) Patent No.: US 12,747,531 B2
(45) Date of Patent: Sep. 29, 2026

(54) TOWEL HEATING BARREL

(71) Applicant: Dongguan Goldenhot PLASTIC & HARDWARE Products Co., Ltd., Dongguan (CN)

(72) Inventors: Xiuhua Zhao, Dongguan (CN); Weiqi Chao, Dongguan (CN)

(73) Assignee: Dongguan Goldenhot PLASTIC & HARDWARE Products Co., Ltd., Dongguan (CN)

( * ) Notice: Subject to any disclaimer, the term of this patent is extended or adjusted under 35 U.S.C. 154(b) by 580 days.

(21) Appl. No.: 18/226,388

(22) Filed: Jul. 26, 2023

(65) Prior Publication Data

US 2024/0328062 A1 Oct. 3, 2024

(30) Foreign Application Priority Data

Mar. 27, 2023 (CN) ..... 202310304724.4

(51) Int. Cl.
*D06F 58/10* (2006.01)
*D06F 58/26* (2006.01)

(52) U.S. Cl.
CPC ..... *D06F 58/10* (2013.01); *D06F 58/26* (2013.01)

(58) Field of Classification Search
CPC ..... D06F 58/10; D06F 58/26; D06F 34/20; D06F 59/08; D06F 2103/40; F24H 7/002; F24H 3/0405; F24H 9/0063; F24H 9/0078; F24H 9/02; F24H 9/1863; F24H 9/2078; F24H 15/128
USPC ..... 34/202
See application file for complete search history.

(56) References Cited

U.S. PATENT DOCUMENTS 5,012,658 A * 5/1991 Shikamori ..... D06F 13/02 68/133

FOREIGN PATENT DOCUMENTS

CN 114672961 A * 6/2022 ..... D06F 58/20
CN 217645569 U * 10/2022

* cited by examiner

*Primary Examiner* — John P McCormack
(74) *Attorney, Agent, or Firm* — Birchwood IP

(57) ABSTRACT

A towel heating barrel, comprising a barrel body, a warm air assembly and a heating circuit arranged inside the barrel body, and also comprising an air duct bracket arranged inside an inner tank to guide the warm air blown out by the warm air assembly from an air outlet to outside of the barrel body, and a weight micro switch elastic head connected in series with the heating circuit and cooperates with the cover to realize the on-off of the heating circuit. In the present application, the air duct bracket provided can make the warm air blown by the warm air assembly flow from the air outlet to the outside of the barrel, so as to prevent the hot air from not being able to circulate out and cause the local part of the barrel to continue to heat up, resulting in excessive temperature and potential safety hazards.

9 Claims, 12 Drawing Sheets

TOWEL HEATING BARREL

TECHNICAL FIELD

The present application relates to the technical field of towel heating barrels, in particular to a towel heating barrel.

BACKGROUND

Towels are a daily necessity. If the towels are not dried in time after use, and the temperature is suitable, there will be a large number of microorganisms on the towels, and the towels will feel greasy to the touch and may have a slight fishy smell. In daily life, people generally wash towels manually. After use, the towels are cleaned and then hung up to dry, but the drying is slow. Along with the continuous improvement of life, towel heaters used in bathrooms have appeared on the market to facilitate heating and drying of towels.

In the common towel heating barrel in the prior art, when the towel is heated, the towel is mostly rolled into a roll or directly placed inside the heating barrel, and then heated. During the specific heating, it is heated by the hot air blown from the air outlet at the bottom of the heating barrel and the heating wire arranged on the side wall of the heating barrel. Although it can achieve a certain heating and drying efficiency, there are still certain shortcomings:

1. When the towels placed inside the heating barrel are rolled into rolls or directly piled up for heating, it will be difficult for local continuous heating to be fully heated and dried. Therefore, the efficiency of heating and drying is low, resulting in relatively low heating and low drying efficiency;
2. Since the towel is placed directly on the inner wall of the heating barrel, it is easy to block the air outlet, which will easily cause the hot air to be unable to circulate out for a long time, so that the towel will continue to be heated locally in the heating barrel, causing the temperature to be too high, which has certain safety hazards;
3. In the common towel heating barrel in the prior art, the warm air generated during heating is circulated and discharged through the air outlet on the cover, but when the warm air is not exhausted smoothly and the user does not find it in time, it will cause the temperature in the barrel continues to rise and pose a safety hazard.

SUMMARY OF THE APPLICATION

In order to solve the technical problems in the prior art, such as low drying efficiency, easy blockage of the air outlet inside the barrel, and when the warm air is not exhausted smoothly and the user does not find it in time, it will cause the temperature in the barrel continues to rise and pose a safety hazard, the specific technical solution of the application is as follows:

A towel heating barrel, comprising a barrel body composed of an inner tank and a shell sleeved outside the inner tank, a cover matched with the inner tank, a heating wire arranged on an outer wall of the inner tank, a warm air assembly arranged between the inner tank and the outer shell, and a heating circuit, wherein further comprising an air duct bracket arranged inside the inner tank to guide warm air blown out by the warm air assembly from an air outlet to outside of the inner tang, and a weight micro switch elastic head connected in series with the heating circuit and cooperates with the cove to realize the on-off of the heating circuit.

As a preferred technical solution of the present application, the air duct bracket comprises a tower-shaped pipe group, connecting shafts arranged on the tower-shaped pipe group, and crossbars, wherein the crossbar can be rotated along the connecting shaft to be accommodated inside the tower-shaped pipe group and placed on the tower pipe group after being stretched and rotated to form a placement part.

As a preferred technical solution of the present application, a guide rod for restricting an axial movement of the crossbar along the connecting shaft is also provided on the tower pipe group, wherein the connecting shafts and the crossbars are symmetrically arranged in two groups, wherein after stretching and rotating along the connecting shaft under the restriction of the guide rod, the two groups of crossbars are placed on the tower pipe group to form a one-line structure.

As a preferred technical solution of the present application, the crossbar comprises two parallel cross rods, and two ends of each cross rod are respectively provided with a U-shaped piece matched with the connecting shaft, wherein two adjacent U-shaped pieces at one end of the two cross rods are connected by a connecting part, and ends of the two adjacent U-shaped pieces at other end are connected with a matching snap-in portion, wherein the tower pipe group comprises a hoop and connecting rods evenly distributed on the hoop.

As a preferred technical solution of the present application, the air duct bracket is connected to the inside of the inner tank by a connecting block, and the connecting block is provided with a snap-in slot, in which the snap-in portion at the end of the crossbar is snapped.

As a preferred technical solution of the present application, an anti-blocking wind groove is provided on the inner wall of the inner tank.

As a preferred technical solution of the present application, a top of the inner tank (11) extends outward to form a flange, the shell is engaged with an outside of the liner and the flange, and the cover covers on the flange.

As a preferred technical solution of the present application, a limiting portion is provided on bottom of the cover and top of the flange, and the weight micro switch elastic head cooperates with the limiting portion to realize the on and off of the heating circuit.

As a preferred technical solution of the present application, the limiting portion comprises a protrusion arranged on the top of the flange and a groove corresponding to the protrusion and arranged under the cover, wherein bumps corresponding to the weight micro switch elastic head are arranged on two pairs of sides of the cover, wherein when the protrusion and the groove are correspondingly engaged, the cover and the flange are in close contact, and the bump abuts against the weight micro switch elastic head, and the heating circuit is in a disconnected state.

As a preferred technical solution of the present application, a handle is provided on the cover, and the cover can be engaged with the flange.

As can be seen from the above technical solutions, the present application has the following beneficial effects: In the present application, the air duct bracket provided can make the warm air blown by the warm air assembly flow from the air outlet to the outside of the barrel, so as to prevent the hot air from not being able to circulate out and cause the local part of the barrel to continue to heat up, resulting in excessive temperature and potential safety hazards. Secondly, the hanging of the towel can be realized, so that it is in a spread state, and the heating and drying efficiency is improved. Through the mutual cooperation of the limit part and the weight micro switch elastic head, the circuit components are in an open circuit state when the cover is tightly closed with the barrel body, so as to avoid the problem that the temperature in the barrel continues to rise and cause safety hazards when the warm air exhaust is not smooth and the user does not find out in time.

Figure 1:
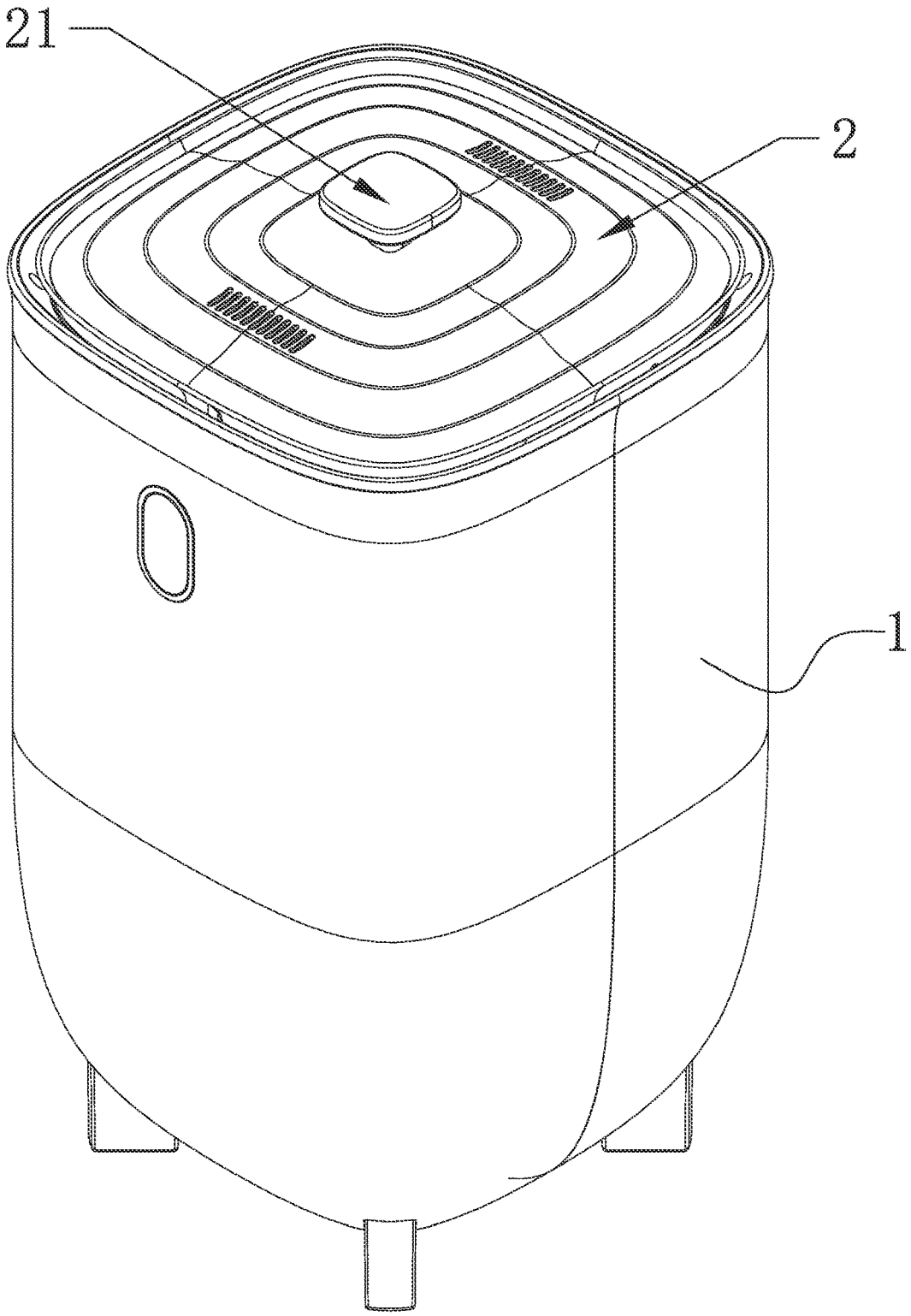
FIG. 1 is the structural schematic diagram of a towel heating barrel proposed by the present application.

Reference signs: 1. Barrel body; 11. Inner tank; 111. Anti-blocking wind groove; 12. Shell; 13. Heating wire; 14. Flange; 2. Cover; 21. Handle; 3. Warm air assembly; 31. Air outlet net; 32. Anti-spray cover; 33. Bottom support; 34. PTC heater; 35. Fan; 36. Fan cover; 4. Air duct bracket; 41. Tower pipe group; 411. Hoop, 412. Connecting rod; 42. Connecting shaft; 43. Crossbar; 431. Cross rod; 432. U-shaped piece; 433. connecting part; 434. Snap-in portion; 44. Guide rod; 45. Connecting block; 451. Snap-in slot; 5. Weight micro switch elastic head; 51. Bump; 6. Protrusion; 61. Groove.

DETAILED DESCRIPTION

The present application will be described in detail below in conjunction with the accompanying drawings and specific embodiments. Before explaining the technical solutions of the various embodiments of the present application in detail, the terms and terms involved will be explained. In this specification, components with the same name or the same number represent similar or identical structures, and are for illustrative purposes only.

EMBODIMENT

Referring to FIG. 1, FIG. 2, FIG. 4 and FIG. 5, a towel heating barrel comprises a barrel body 1 composed of an inner tank 11 and a shell 12 sleeved outside the inner tank 11, a cover 2 matched with the inner tank 11, a heating wire 13 arranged on an outer wall of the inner tank 11, a warm air assembly 3 arranged between the inner tank 11 and the outer shell 12, and a heating circuit, wherein further comprises an air duct bracket 4 arranged inside the inner tank 11 to guide warm air blown out by the warm air assembly 3 from an air outlet to outside of the inner tang 11, and a weight micro switch elastic head 5 connected in series with the heating circuit and cooperates with the cover 2 to realize the on-off of the heating circuit. When in use, the air guide tube support 4 is placed inside the inner container 11, and the air duct bracket 4 can isolate the towel from the warm air outlet. At this time, the warm air blown out by the warm air assembly 3 through the air outlet can circulate well from the inside of the inner tank 11 to the outside of the barrel body 1, so as to avoid potential safety hazards caused by excessive internal temperature of the barrel body 1. Secondly, the weight micro switch elastic head 5 is a normally closed switch, through the weight micro switch elastic head 5 matched with the cover 2, when the cover 2 and the liner 11 are in close contact, the cover 2 will act on the weight micro switch elastic head 5 to make it disconnected. At this time, the heating barrel circuit cannot be energized, and the towel will not be heated. When the cover 2 and the inner tank 11 are not tightly sealed, there will be a certain gap between the two, and the gap can allow the generated warm air to circulate. At this time, the cover 2 will not act on the weight micro switch elastic head 5, which is still in the closed state. At this time, the heating barrel can be normally started for heating operation, so the weight micro switch elastic head 5 can automatically switch on and off the heating circuit to ensure the safety performance during heating.

The warm air assembly 3 comprises an air outlet net 31 arranged at the bottom of the inner tank 11 and connected to the inside thereof, an anti-spray cover 32 arranged at the axis of the air outlet net 31, a bottom support 33 sleeved on the outer wall of the air outlet net 31, a PTC heater 34 arranged at the bottom of the bottom support 33 and corresponding to the anti-spray cover 32 and a fan 35 arranged on the inner wall of the shell12 and matched with the PTC heater 34. A through hole corresponding to the anti-spray cover 32 and through which the heating air passes is provided at the axis of the bottom support33. A fan cover 36 is arranged on the outer wall of the fan 35. When in use, the warm air assembly 3 generates warm air through the heating circuit and the power cable, the fan 35 and the PTC heater 34 and cooperates with the air outlet net 31 to achieve better blowing of warm air to the inside of the inner tank 11 and better contact with the towel, so as to improve the drying efficiency. The provided bottom support 33 collects the water flowing out from the towel, cooperates with the anti-spray cover 32 to prevent the water on the towel from dripping onto the PTC heater 34 and the fan 35 and causing damage to it.

Figure 8:
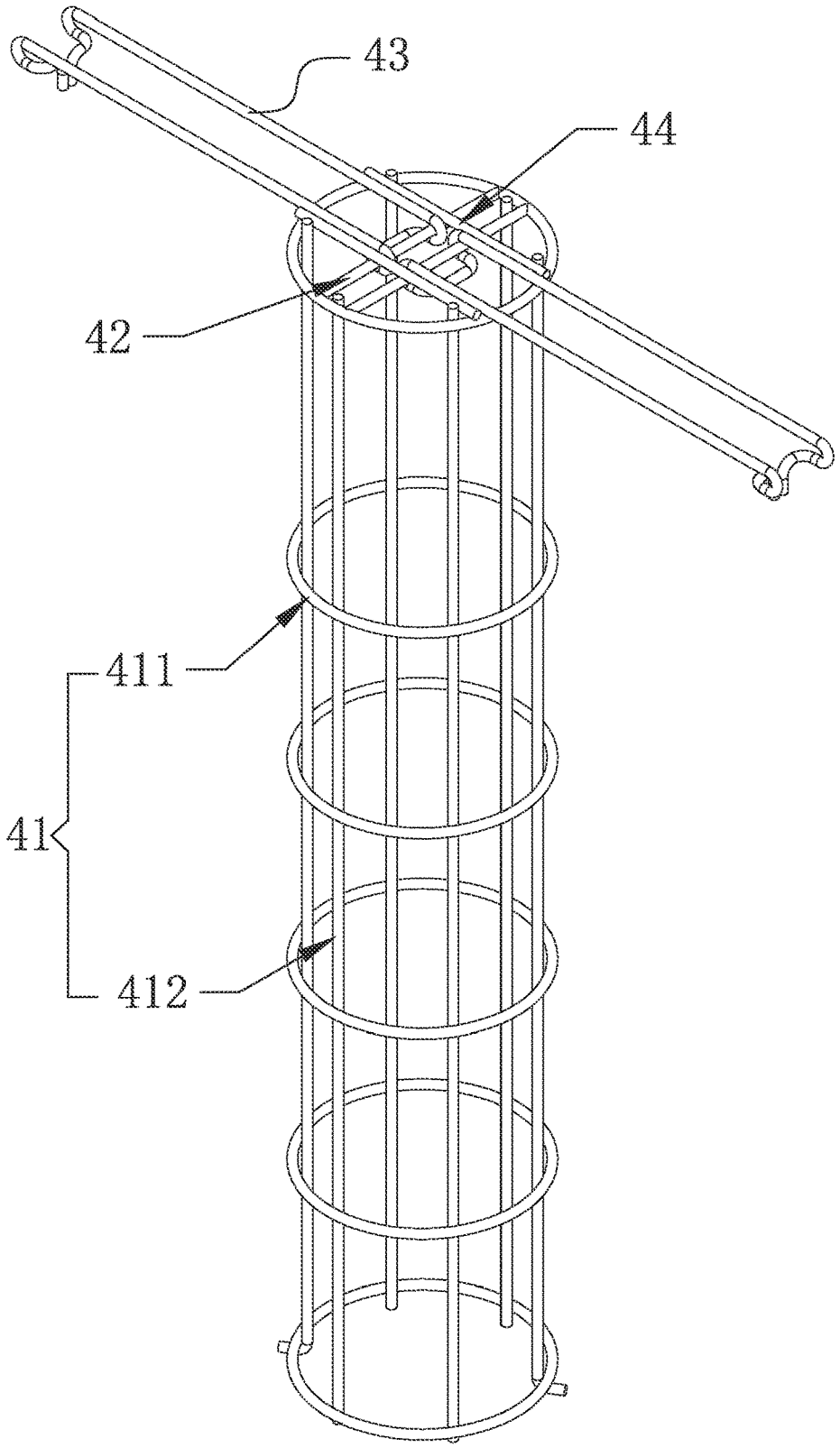
FIG. 8 is a structural schematic diagram of a unfolded state of the bracket in a towel heating barrel proposed by the present application.
Figure 9:
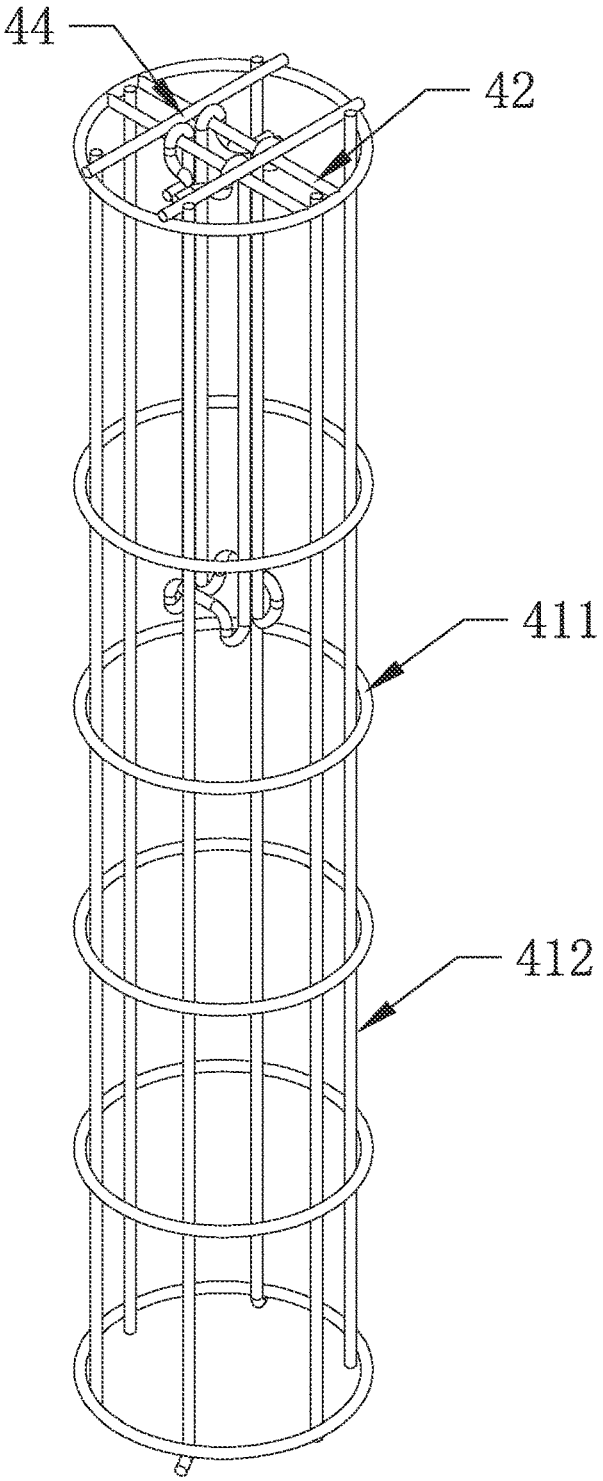
FIG. 9 is a structural schematic diagram of a storage state of the bracket in a towel heating barrel proposed by the present application.

Referring to FIGS. 8 and 9, the air duct bracket 4 comprises a tower-shaped pipe group 41, connecting shafts 42 arranged on the tower-shaped pipe group 41, and crossbars 43, wherein the crossbar can be rotated along the connecting shaft 42 to be accommodated inside the tower-shaped pipe group 41 and placed on the tower pipe group41 after being stretched and rotated to form a placement part. When in use, the crossbar 43 is stretched, rotated, stretched out and placed on the tower pipe group 41, at this time, the towel to be heated can be hung on the crossbar 43. At this time, the towel is in a spread state, so that the items can be fully heated, which is different from the traditional roll-shaped partial heating, which effectively improves the heating and drying efficiency. Secondly, the tower-shaped pipe group 41 can well isolate the towel from the warm air outlet, so that the warm air blown out by the warm air assembly 3 can circulate well from the inside of the inner tank 11 to the outside of the barrel body 1 through the air outlet, avoiding the internal temperature of the barrel body 1 is too high to cause a safety hazard.

Referring to FIGS. 8 and 9, a guide rod 44 for restricting an axial movement of the crossbar 43 along the connecting shaft 42 is also provided on the tower pipe group 41, wherein the connecting shafts 42 and the crossbars 43 are symmetrically arranged in two groups, wherein after stretching and rotating along the connecting shaft 42 under the restriction of the guide rod 44, the two groups of crossbars 43 are placed on the tower pipe group 41 to form a one-line structure. After the two groups of crossbars 43 are unfolded in a straight line, it is convenient to hang the towels on the crossbars 43 evenly, so that the towels can be in a spread state, so that the towels can be fully heated, and the heating and drying efficiency is increased.

Figure 10:
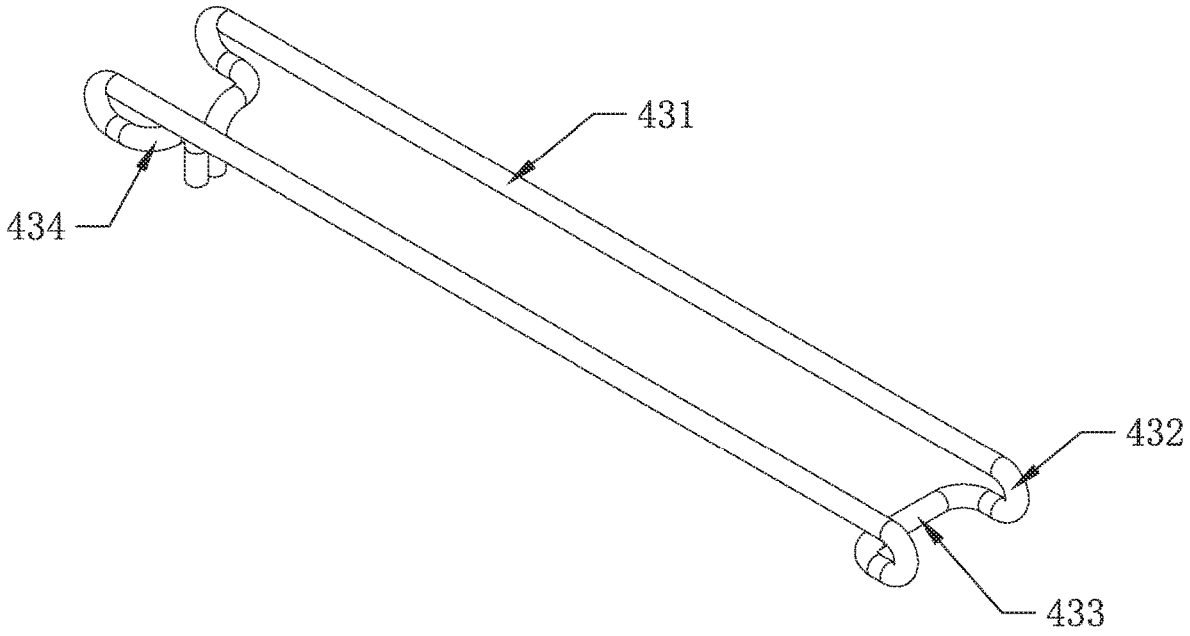
FIG. 10 is a first structural schematic diagram of a crossbar of a towel heating barrel proposed by the present application.
Figure 11:
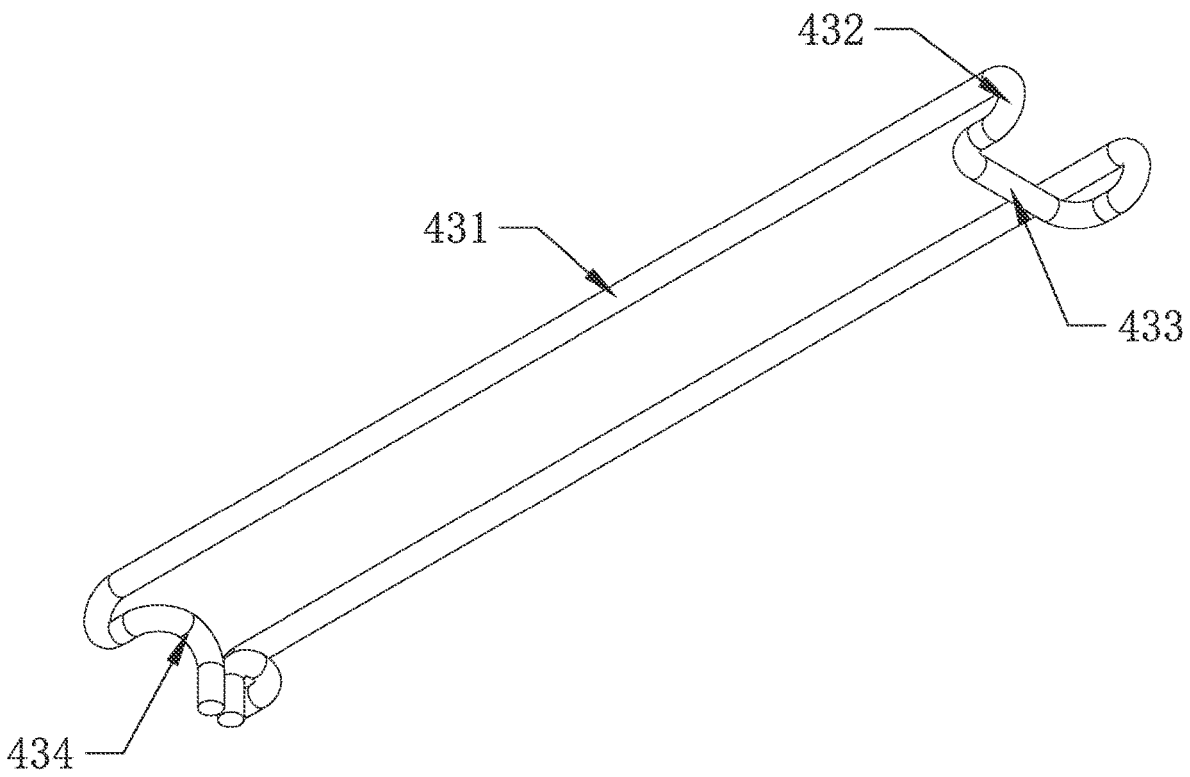
FIG. 11 is a second structural schematic diagram of a crossbar of a towel heating barrel proposed by the present application.

Referring to FIGS. 10 and 11, the crossbar 43 comprises two parallel cross rods 431, and two ends of each cross rod 431 are respectively provided with a U-shaped piece 432 matched with the connecting shaft 42, wherein two adjacent U-shaped pieces 432 at one end of the two cross rods 431 are connected by a connecting part 433, and ends of the two adjacent U-shaped pieces 432 at other end are connected with a matching snap-in portion 434, wherein the tower pipe group 41 comprises a hoop 411 and connecting rods 412 evenly distributed on the hoop 411. The U-shaped piece 432 cooperates with the guide rod 44 to make the crossbar 43 more stable when unfolded or stored. The air duct bracket 4 can be fixed inside the inner tank 11 conveniently and quickly through the snap-in portion 434. The tower pipe group 41 adopts the combination of the hoop 411 and the connecting rod 412, which can not only isolate the towel from the air outlet, but also have a good air guiding effect.

Figure 4:
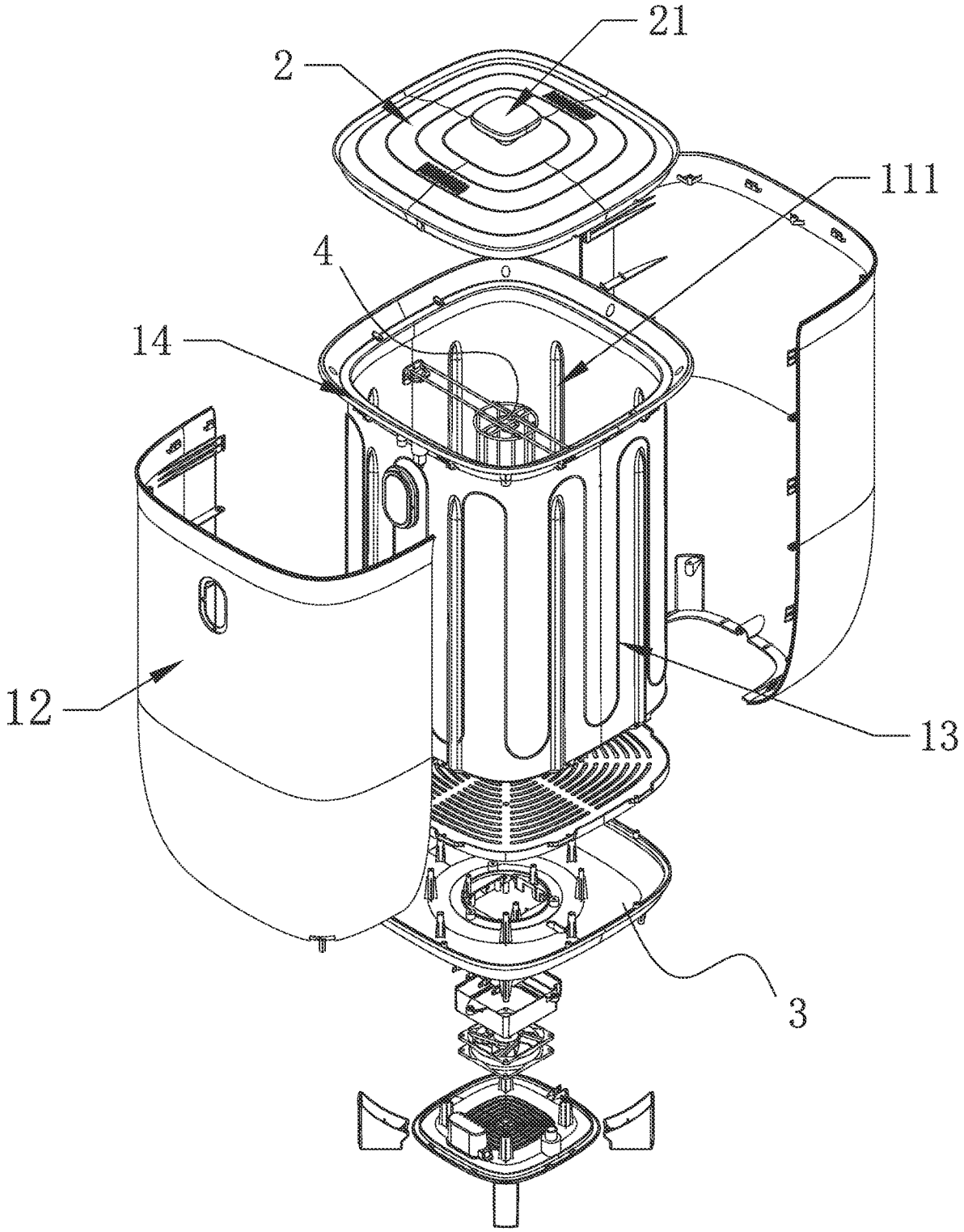
FIG. 4 is a first structural schematic diagram of a disassembled state of a towel heating barrel proposed by the present application.
Figure 5:
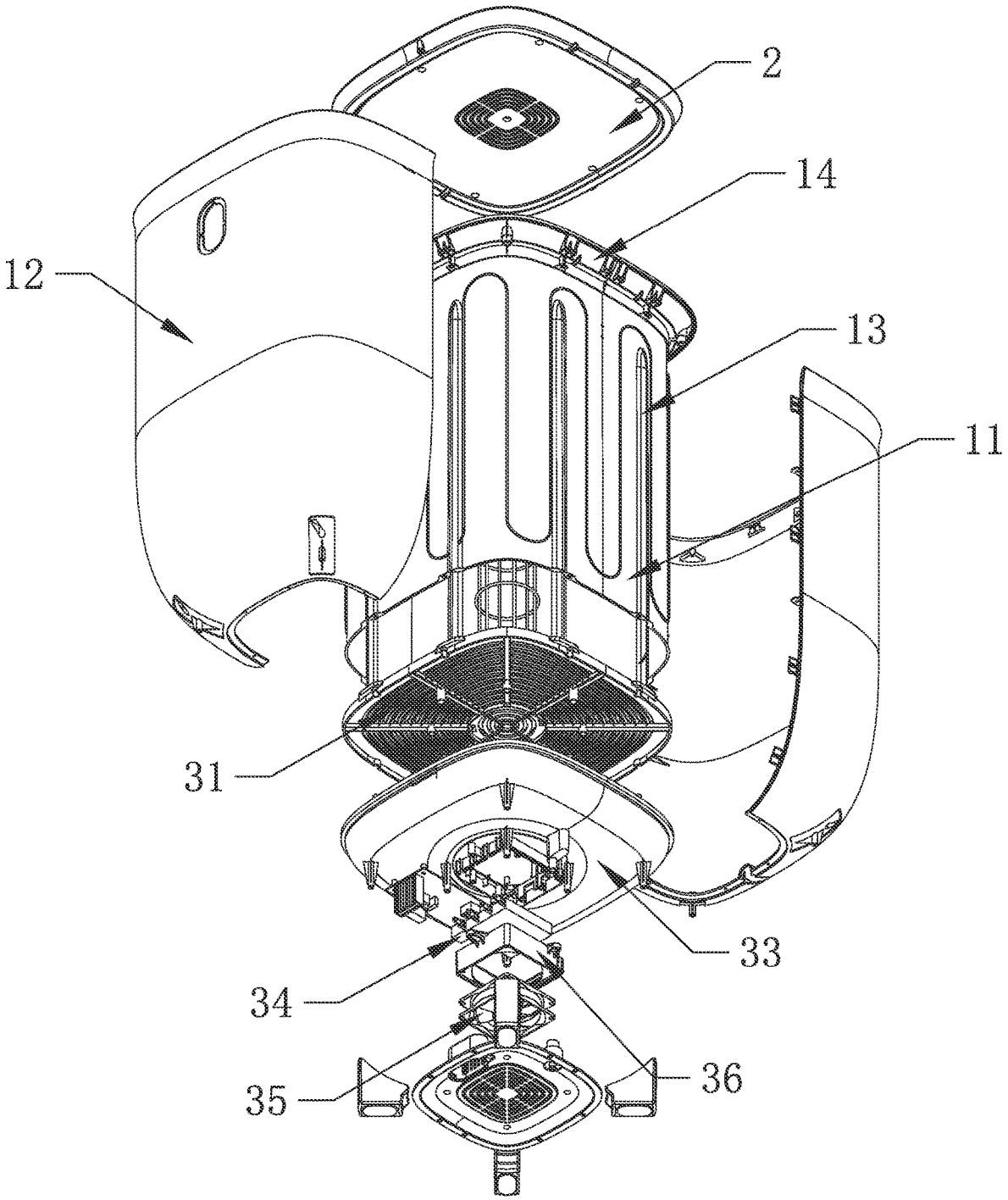
FIG. 5 is a second structural schematic diagram of a disassembled state of a towel heating barrel proposed by the present application.
Figure 12:
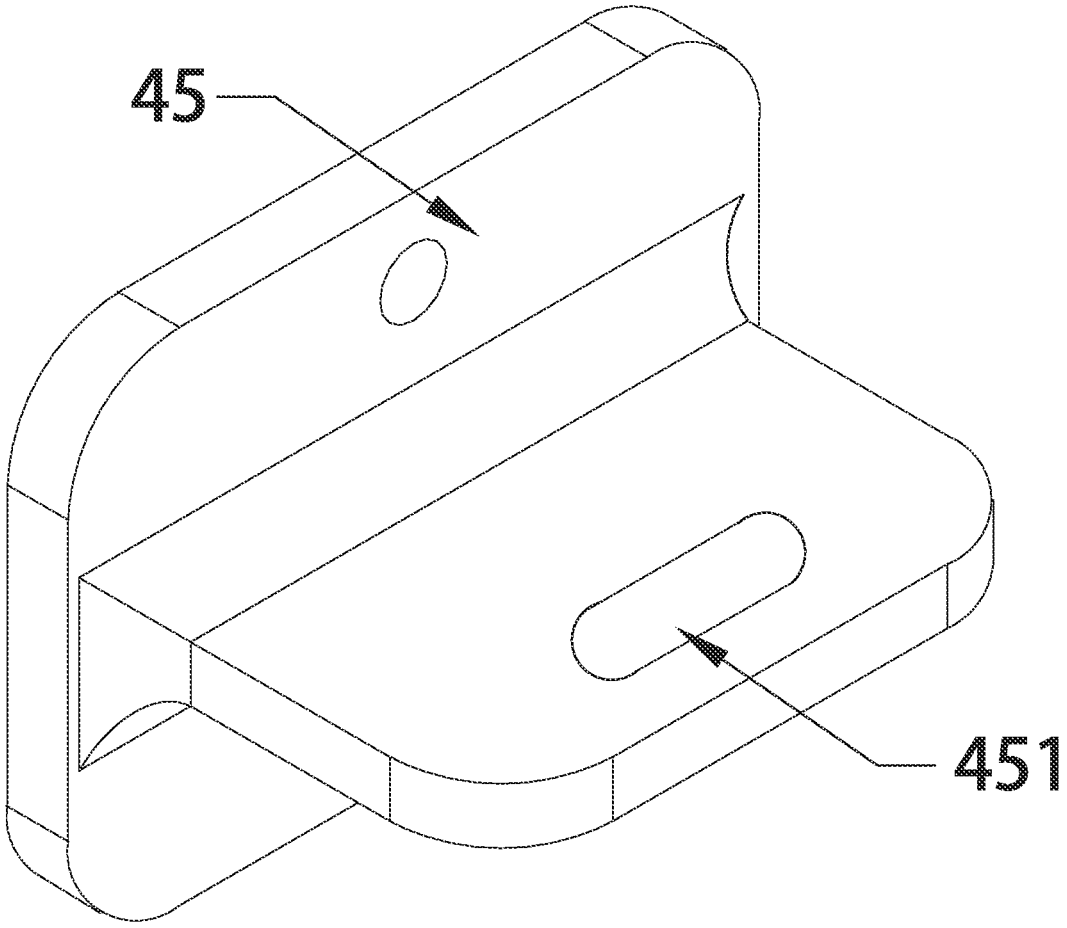
FIG. 12 is a structural schematic diagram of a connecting block of a towel heating barrel proposed by the present application.

Referring to FIG. 4, FIG. 10 and FIG. 12, the air duct bracket 4 is connected to the inside of the inner tank 11 by a connecting block 45, and the connecting block 45 is provided with a snap-in slot 451, in which the snap-in portion 434 at the end of the crossbar 43 is snapped. It is convenient and quick to disassemble and assemble the air duct bracket 4 through the provided snap-in slot 451 matched with the snap-in portion 434.

Figure 2:
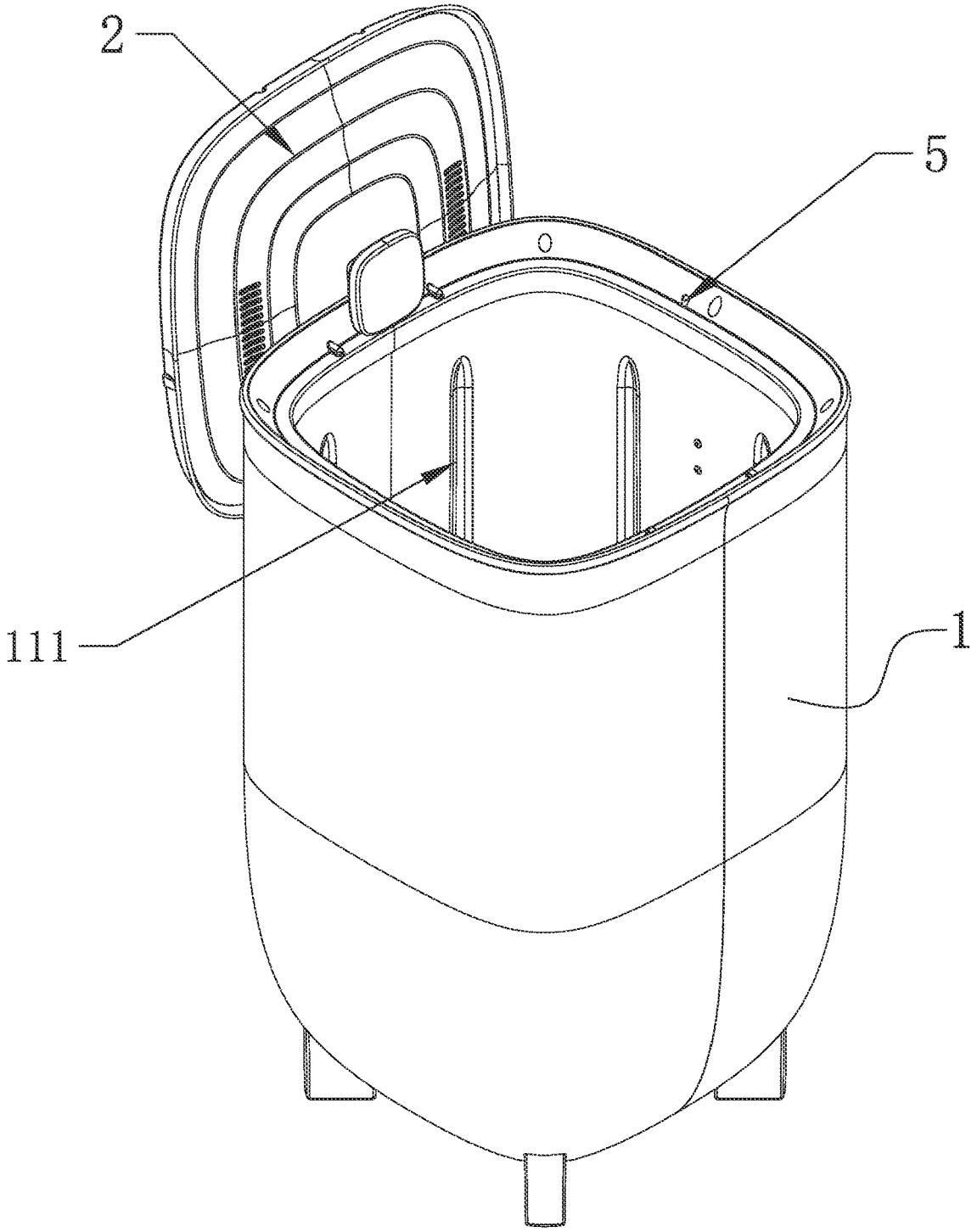
FIG. 2 is a structural schematic diagram of the engaged state of the barrel body and the cover of a towel heating barrel proposed by the present application.

Referring to FIG. 2 and FIG. 4, further in order to improve the wind guiding effect inside the barrel body 1, an anti-blocking wind groove 111 is provided on the inner wall of the inner tank 11.

Figure 3:
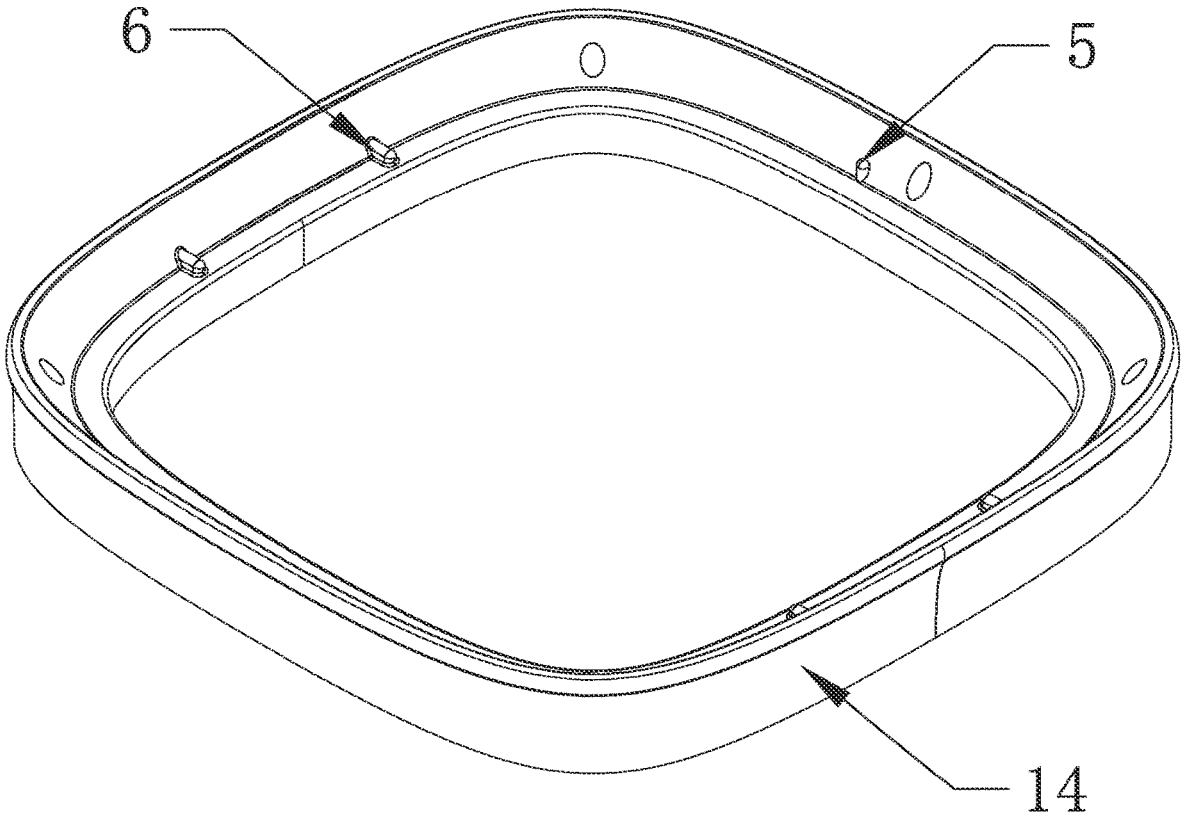
FIG. 3 is a structural schematic diagram of a flange in a towel heating barrel proposed by the present application.

Referring to FIG. 2 and FIG. 3, a top of the inner tank 11 extends outward to form a flange 14, the shell 12 is engaged with an outside of the liner 11 and the flange 14, and the cover 2 covers on the flange 14.

Referring to FIG. 2 and FIG. 3, a limiting portion is provided on bottom of the cover 2 and top of the flange 14, and the weight micro switch elastic head 5 cooperates with the limiting portion to realize the on and off of the heating circuit. The relative position of the cover 2 and the flange 14 can be changed through the provided limiting portion, so as to realize whether the cover 2 and the flange 14 are in close contact. When the cover 2 and the flange 14 are tightly sealed, the weight micro switch elastic head 5 is in the disconnected state, and the heating circuit is disconnected, and the towel heating operation cannot be performed, so as to avoid the continuous rise of the internal temperature of the barrel body 1 due to poor air conduction, thereby causing potential safety hazards. When there is a gap between the cover 2 and the flange 14, it can ensure that the inside of the barrel body 1 is unobstructed for air guidance, and the weight micro switch elastic head 5 is in a closed state, and the towel heating operation can be performed at this time.

Figure 6:
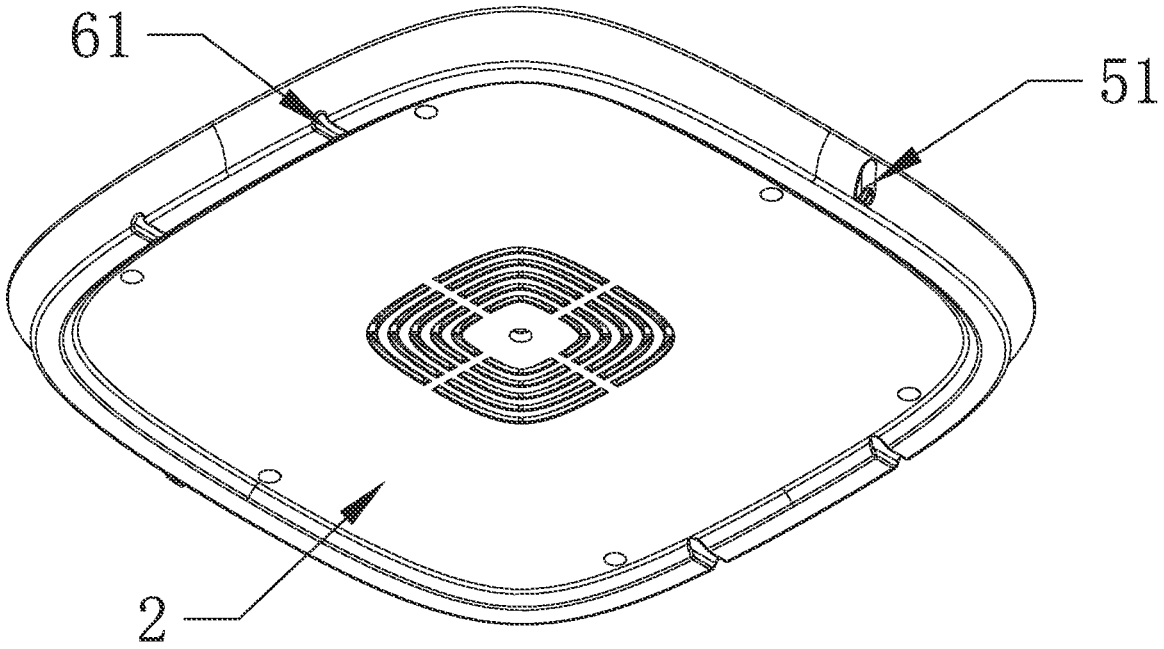
FIG. 6 is a structural schematic diagram of a cover of a towel heating barrel proposed by the present application.
Figure 7:
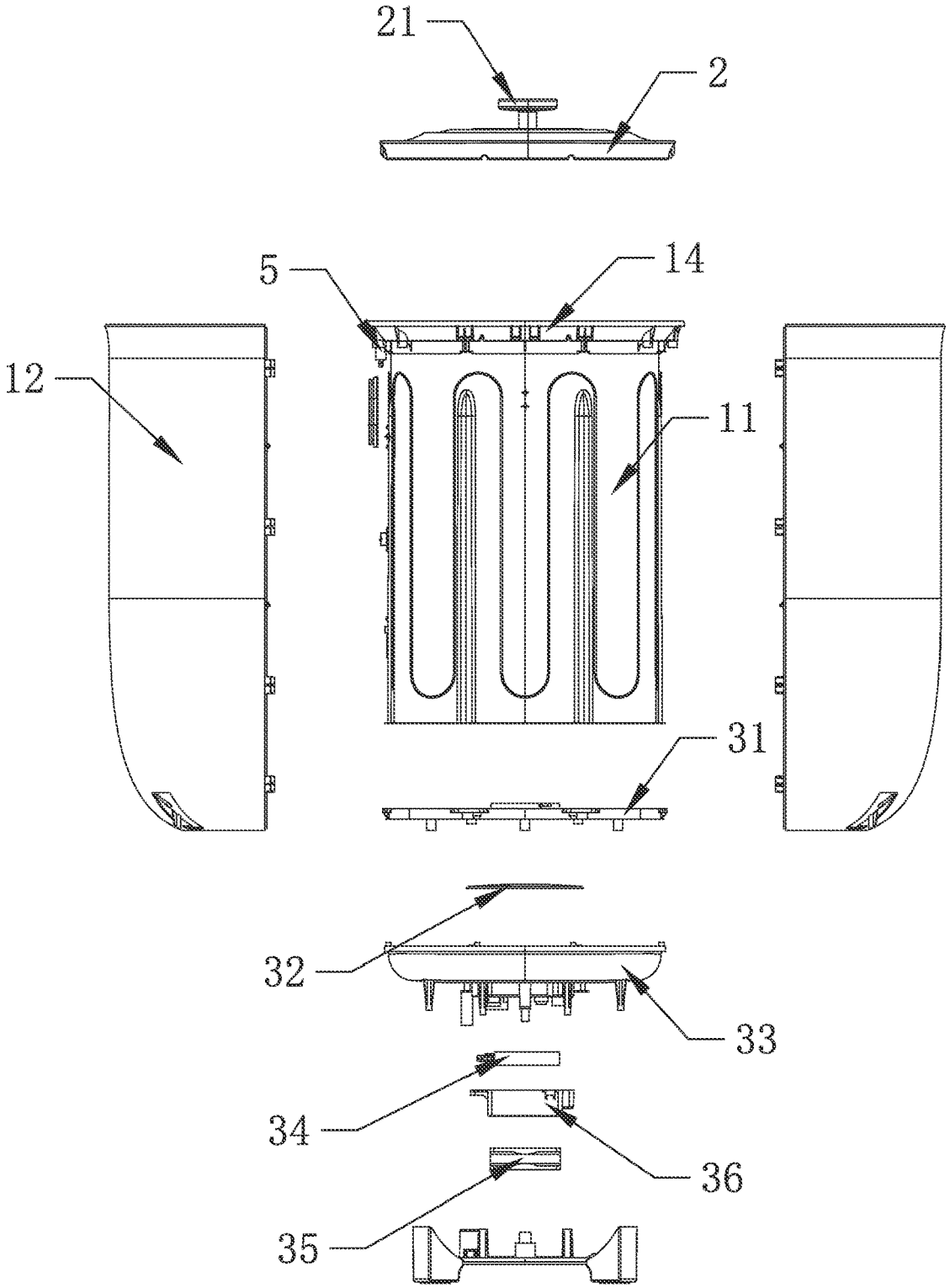
FIG. 7 is a third structural schematic diagram of a disassembled state of a towel heating barrel proposed by the present application.

Referring to FIG. 2, FIG. 3 and FIG. 6, the limiting portion comprises a protrusion 6 arranged on the top of the flange 14 and a groove 61 corresponding to the protrusion 6 and arranged under the cover 2, wherein bumps 51 corresponding to the weight micro switch elastic head 5 are arranged on two pairs of sides of the cover 2, wherein when the protrusion 6 and the groove 61 are correspondingly engaged, the cover 2 and the flange 14 are in close contact, and the bump 51 abuts against the weight micro switch elastic head 5, and the heating circuit is in a disconnected state. The provided bump 51 can make the cover 2 act better on the weight micro switch elastic head 5. When the protrusion 6 and the groove 61 are snapped together, the cover 2 and the inner tank are in a tight state, that is, the bump 51 will act on the weight micro switch elastic head 5 to make it in a disconnected state, and the circuit cannot form a loop and cannot carry out heating and drying operations to ensure the safety of the heating barrel when used.

Referring to FIG. 2, a handle 21 is provided on the cover 2, and the cover 2 can be engaged with the flange 14 to facilitate the placement of the cover 2.

The embodiments described above are only descriptions of the preferred embodiments of the present application, and are not intended to limit the scope of the present application. On the premise of not departing from the design spirit of the present application, various modifications and improvements made by those skilled in the art to the technical solution of the present application shall fall within the protection scope determined by the claims of the present application.

What is claimed is:

1. A towel heating barrel, comprising: a barrel body composed of an inner tank and a shell, a cover matched with the inner tank, a heating wire arranged on an outer wall of the inner tank, a warm air assembly arranged between the inner tank and the shell, and a heating circuit, wherein further comprising an air duct bracket arranged inside the inner tank to guide warm air blown out by the warm air assembly from an air outlet to outside of the inner tank, and a weight micro switch elastic head connected in series with the heating circuit and cooperates with the cover to realize the on-off of the heating circuit;

wherein an anti-blocking wind groove is provided on an inner wall of the inner tank.

2. The towel heating barrel according to claim 1, wherein the air duct bracket comprises a tower-shaped pipe group, connecting shafts arranged on the tower-shaped pipe group, and crossbars, wherein the crossbar can be rotated along the connecting shafts to be accommodated inside the tower-shaped pipe group and placed on the tower-shaped pipe group after being stretched and rotated to form a placement part.

3. The towel heating barrel according to claim 2, wherein a guide rod for restricting axial movements of the crossbars along the connecting shafts is also provided on the tower-shaped pipe group, wherein the connecting shafts and the crossbars are symmetrically arranged in two groups, wherein after stretching and rotating along the connecting shafts under the restriction of the guide rod, the two groups of crossbars are placed on the tower-shaped pipe group to form a one-line structure.

4. The towel heating barrel according to claim 3, wherein the crossbars comprise two parallel cross rods, and two ends of each cross rod are respectively provided with U-shaped pieces matched with the connecting shafts, wherein two adjacent U-shaped pieces at one end of the two cross rods are connected by a connecting part, and ends of the two adjacent U-shaped pieces at other end are connected with a matching snap-in portion, wherein the tower-shaped pipe group comprises a hoop and connecting rods evenly distributed on the hoop.

5. The towel heating barrel according to claim 4, wherein the air duct bracket is connected to the inside of the inner tank by a connecting block, and the connecting block is provided with a snap-in slot, in which the snap-in portion at an end of the crossbars is snapped.

6. The towel heating barrel according to claim 1, wherein a top of the inner tank extends outward to form a flange, the shell is engaged with an outside of the inner tank and the flange, and the cover covers on the flange.

7. The towel heating barrel according to claim 6, wherein a limiting portion is provided on a bottom of the cover and a top of the flange, and the weight micro switch elastic head cooperates with the limiting portion to realize the on and off of the heating circuit.

8. The towel heating barrel according to claim 7, wherein the limiting portion comprises a protrusion arranged on the top of the flange and a groove corresponding to the protrusion and arranged under the cover, wherein bumps corresponding to the weight micro switch elastic head are arranged on two pairs of sides of the cover, wherein when the protrusion and the groove are correspondingly engaged, the cover and the flange are in close contact, and the bumps abut against the weight micro switch elastic head, and the heating circuit is in a disconnected state.

9. The towel heating barrel according to claim 6, wherein a handle (21) is provided on the cover (2), and the cover is configured to be engaged with the flange.

* * * * *